United States Patent [19]

Balk

[11] Patent Number: 4,820,142

[45] Date of Patent: Apr. 11, 1989

[54] APPARATUS FOR MAKING A SPUN-FILAMENT FLEECE

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 119,141

[22] Filed: Nov. 10, 1987

[30] Foreign Application Priority Data

Apr. 25, 1987 [DE] Fed. Rep. of Germany ..... 3713862

[51] Int. Cl.[4] ..... B29C 47/34

[52] U.S. Cl. ..... 425/66; 264/211.14; 264/237; 425/72.2; 425/141

[58] Field of Search ..... 19/299, 300; 28/185, 28/240, 241, 273; 264/12, 103, 176.1, 177.17, 177.19, 210.8, 211.14, 211.17, 237, 518, 290.5, DIG. 73, DIG. 75; 425/66, 72.1, 72.2, 80.1, 81.1, 82.1, 140, 141, 172, 83.1, 462, 464

[56] References Cited

U.S. PATENT DOCUMENTS 3,812,553 5/1974 Marshall et al. ..... 425/81.1
4,442,062 4/1984 Fujii et al. ..... 19/299
4,692,106 9/1987 Grabowski et al. ..... 425/66

FOREIGN PATENT DOCUMENTS 2906618 8/1980 Fed. Rep. of Germany ..... 264/237

*Primary Examiner*—Jay H. Woo
*Assistant Examiner*—C. Scott Bushey
*Attorney, Agent, or Firm*—Herbert Dubno

[57] ABSTRACT

The fleece spinning unit has a spinning nozzle system, a cooling shaft, a stretching aperture, a diffuser shaft, a continuously moving fleece receiving conveyor and a device for feeding process air and for drawing outflowing air through the fleece receiving conveyor. The cooling shaft has a shaft wall provided with a plurality of air orifices. Thus process air required for the cooling is fed into the cooling shaft and is at least partially drawn through the fleece receiving conveyor. The thickness of the spun fleece is measurable on the fleece receiving conveyor downstream of the diffuser shaft in the transport direction. A measured value/set-point comparison is made and on deviation of the measured value from the set-point the setting angles of opposing air control flaps which are located at the entrance of the stretching aperture are changed. On a positive deviation of the measured value of the thickness from the set-point the setting angle is increased. On a negative deviation from the set-point the setting angle is decreased.

4 Claims, 2 Drawing Sheets

APPARATUS FOR MAKING A SPUN-FILAMENT FLEECE

FIELD OF THE INVENTION

My present invention relates to an apparatus for making a spun-filament fleece or mat from a synthetic-resin filament.

BACKGROUND OF THE INVENTION

A apparatus for making spun-filament fleece for making a spun-filament fleece is known comprising a spinning nozzle system or spinneret, a cooling shaft for the continuous spun filament, a stretching gap (e.g. a venturi passage in which air flow is accelerated), a diffuser shaft, a continuously moving fleece receiving conveyor and a device for feeding process air and for drawing outflowing air through the fleece receiving conveyor.

The cooling shaft has a shaft wall provided with a plurality of air orifices and process air required for cooling can be introduced through the air orifices to provide an air flow. The air flow is at least partially drawn through the fleece receiving conveyor.

In the known apparatus for making a spun-filament fleece or mat the process parameters such as the flow rates of thermoplastic material and process air the transport speed of the fleece receiving conveyor and the geometric parameters of the apparatus for making a spun-filament fleece are set up in practice so that the spun-filament fleece has a thickness, or surface weight (area weight), which is as uniform and exact as possible. However it is not possible with the features of the known process and/or in the apparatus for making spun-filament fleece to successfully correct or even regulate the thickness variations of the spun-filament fleece or the deviations from a uniform thickness.

OBJECTS OF THE INVENTION

It is an object of my invention to provide an improved apparatus for making spun-filament fleece from endless synthetic filament which will obviate the aforedescribed drawbacks.

It is also an object of my invention to provide an improved apparatus for making spun-filament fleece from endless synthetic filament with which deviations of the thickness of the spun-filament fleece from a predetermined set value can be easily corrected.

It is another object of my invention to provide an improved fleece spinning unit with which deviations from uniformity of thickness over the entire width of the spun-filament fleece are corrected in an easy way.

SUMMARY OF THE INVENTION

These objects and others which will become more readily apparent hereinafter are attained in accordance with my invention in a apparatus comprising a spinning nozzle system or spinneret, a cooling shaft, a stretching gap, a diffuser shaft, a continuously moving fleece receiving conveyor upon which the nonwoven mat is deposited and a device for feeding process air and for drawing outflowing air through the fleece receiving conveyor. The cooling shaft has a shaft wall provided with a plurality of air orifices and process air required for cooling can be introduced through the air orifices to provide an air flow. The air flow is at least partially drawn through the fleece receiving conveyor.

According to my invention the fleece receiving conveyor, which is for example a wire screen conveyor, is equipped with a thickness measuring device for the thickness of the spun-filament fleece which is measured or ascertained as an average value, or at discrete points over the entire width of the spun-filament fleece, and at least one air control flap with a horizontal pivot axis is positioned upstream of the stretching gap whose setting angle is adjustable against the air flow direction according to the deviation of the measured value and/or values of the thickness from a setpoint value or values of the thickness.

Advantageously two opposing air control flaps are provided which are synchronously adjustable in mirror symmetrical relation. When discrete thickness measurements over the entire width of the spun-filament fleece are undertaken, advantageously the air control flap or flaps can be elastically deformable and adjustable to different setting angles over their entire lengths respectively. This provides a control on the uniformity of the spun-filament fleece thickness across the width of the mat.

In the apparatus for making spun-filament fleece according to my invention the adjustment of the air control flaps can be performed from time to time considering the described measured values, for example by manual control. In an advantageous example of my invention the thickness measurement device and the air control flaps are provided in a feedback control loop which has a suitable servomotor drive and to which adjustable setpoint values of the spun-filament fleece thickness are associated.

An advantage of my invention is such that deviations of the thickness of the spun-filament fleece from a predetermined set value can be corrected in an easy way in the apparatus for making spun-filament fleece and thus a very exact and uniform thickness distribution is attained.

With the device or apparatus according to my invention in an easy way a particularly desirable process for making a spun-filament fleece is realized which permits the thickness of the spun-filament fleece on the fleece receiving conveyor to be measured in the transport direction downstream of the diffuser shaft and that measured value to be compared with a set value. On deviation of the measured value from the setpoint value the setting angles of the air control flaps which are positioned at the entrance of the stretching gap are varied. Of particular advantage is the fact that the spun-filament fleece device according to my invention does not differ substantially in its cost from the existing device because in addition only the measuring device and the air control flaps need be provided. The manufactured product, namely the spun-filament fleece made from a synthetic endless filament, is noticeably improved in its quality.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
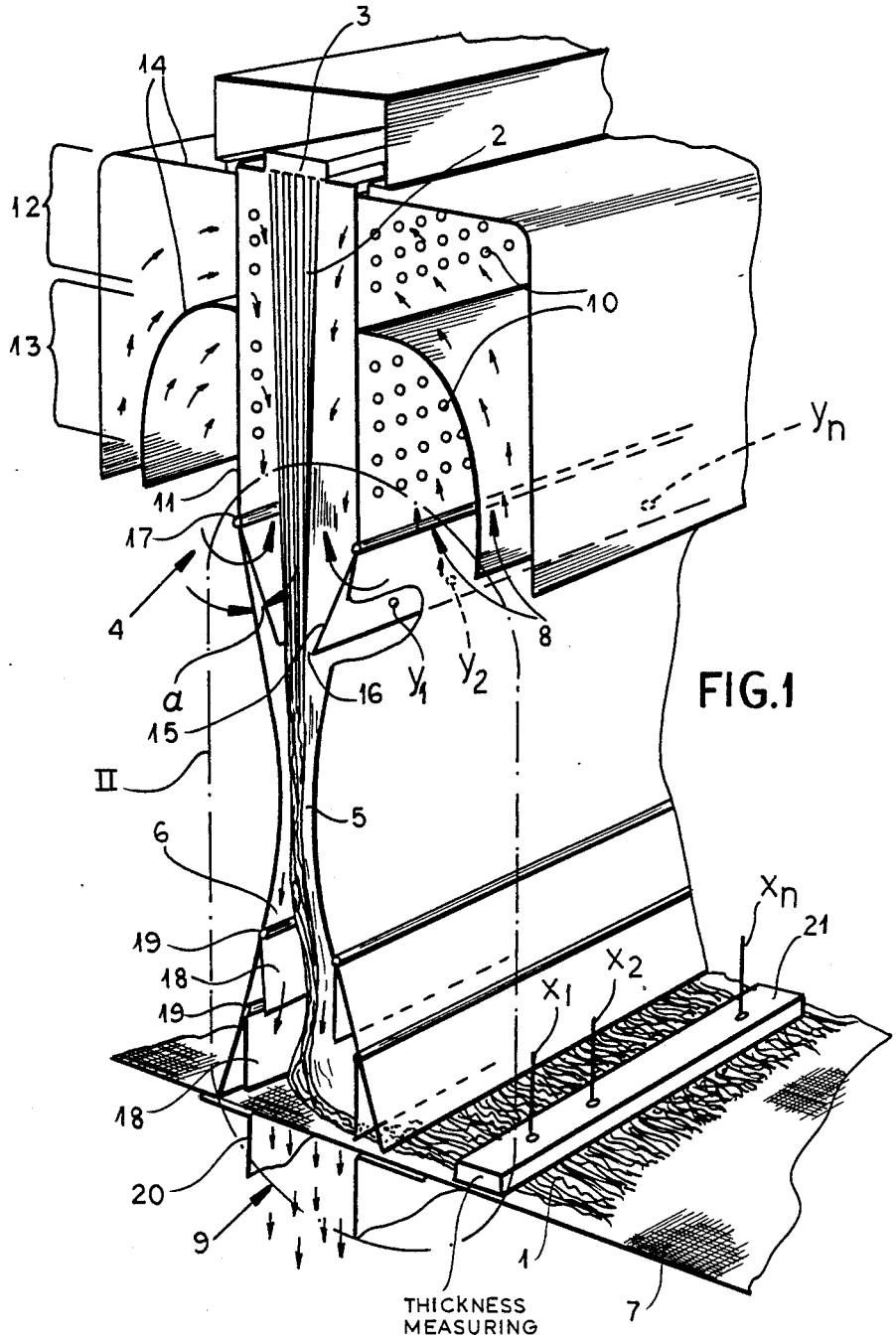
FIG. 1 is a perspective view of a vertically cutaway portion of a apparatus for making spun-filament fleece according to my invention.

The device or apparatus shown in the drawing produces a spun-filament fleece 1 made from endless synthetic filament 2. This device comprises a spinning nozzle system or spinneret 3, a cooling shaft 4, a stretching gap 5, a diffuser shaft 6 and a fleece delivery conveyor 7. In addition devices 8, 9 for feeding process air and for drawing outgoing air through the fleece receiving conveyor 7 are provided.

The cooling shaft 4 has a shaft wall 11 provided with a plurality of air orifices 10. The shaft wall 11 however can also be formed as a flow directing device in the shape of a screen. Because of that process air required for cooling can be introduced into the cooling shaft 4.

The cooling shaft 4 has an upper intensive cooling region 12 and a lower additional cooling region 13 as well as suitable air flow dividing guiding walls or baffles 14 connected to the shaft wall 11. The air flow dividing guiding walls 14 are of adjustable height and the height of the intensive cooling region 12 is adjustable because of that height adjustability.

Air control flaps 15 converging like a wedge in the feed direction of the endless filaments 2 connected to the shaft wall 11 are connected in series with the stretching gap 5.

These flaps 15 have an outlet gap 16 which opens to the stretching aperture 5. The gap 5 has a venturi configuration through which air is accelerated to effect the stretching of the filaments emerging from the spinneret. The air control flaps 15 have an outlet gap 16 which opens to the stretching gap 5. These air control flaps 15 have an adjustable setting angle a and are movable about a horizontal axis 17 as is indicated in the figure by curved arrows. The device is designed so that the setting angle a and thus the width of the outlet gap 16 is adjustable differently over the entire length of the air control flaps 15. For that suitable (e.g. servomotor) positioning elements can be provided and the flaps are flexible.

The diffuser shaft 6 is provided with pivotable flaps 18 defining the flow cross section and which are each movable about a horizontal axis 19. They are positioned above each other in the example in several steps and are adjustable independently of each other. Also they can be set at different setting angles with suitable positioning elements.

The device 9 for drawing outflowing air includes an adjustable damper 20 above and/or below the fleece receiving conveyor 7 with which the width of the outflowing, air flow measured in the transport direction of the fleece receiving conveyor 7 is adjustable. It can be operated with a closed or partially closed air flow for the process air and for the outflowing air.

In any case the apparatus according to my invention does not operate with three separate air flows but with a single process air flow which, as described, is divided into a partial flow of air for the intensive cooling region 12 and a partial air flow for the additional cooling region 13.

The fleece receiving conveyor 7, which for example is constructed as a wire cloth conveyor, is equipped with a thickness measuring device 21 for the thickness of the spun-filament fleece 1. The thickness of the spun-filament fleece 1 is thus measured over the entire spun-filament fleece width or at discrete measuring points $x_1, x_2, \ldots, x_n$.

The air control flaps 15 positioned upstream of the stretching gap 5, which have a horizontal pivot axis 17, are adjustable in regard to their setting angle a against the air flow according to the variation of the actual measured value of the thickness from a desired setpoint value.

In the embodiment illustrated, two opposing air control flaps 15 are positioned which are synchronously adjustable. The air control flaps 15 are elastically deformable and consequently can be set at different setting angles over their entire length and of course at $y_1, y_2, \ldots, y_n$ corresponding to the measured points $x_1, x_2, \ldots, x_n$.

Figure 2:
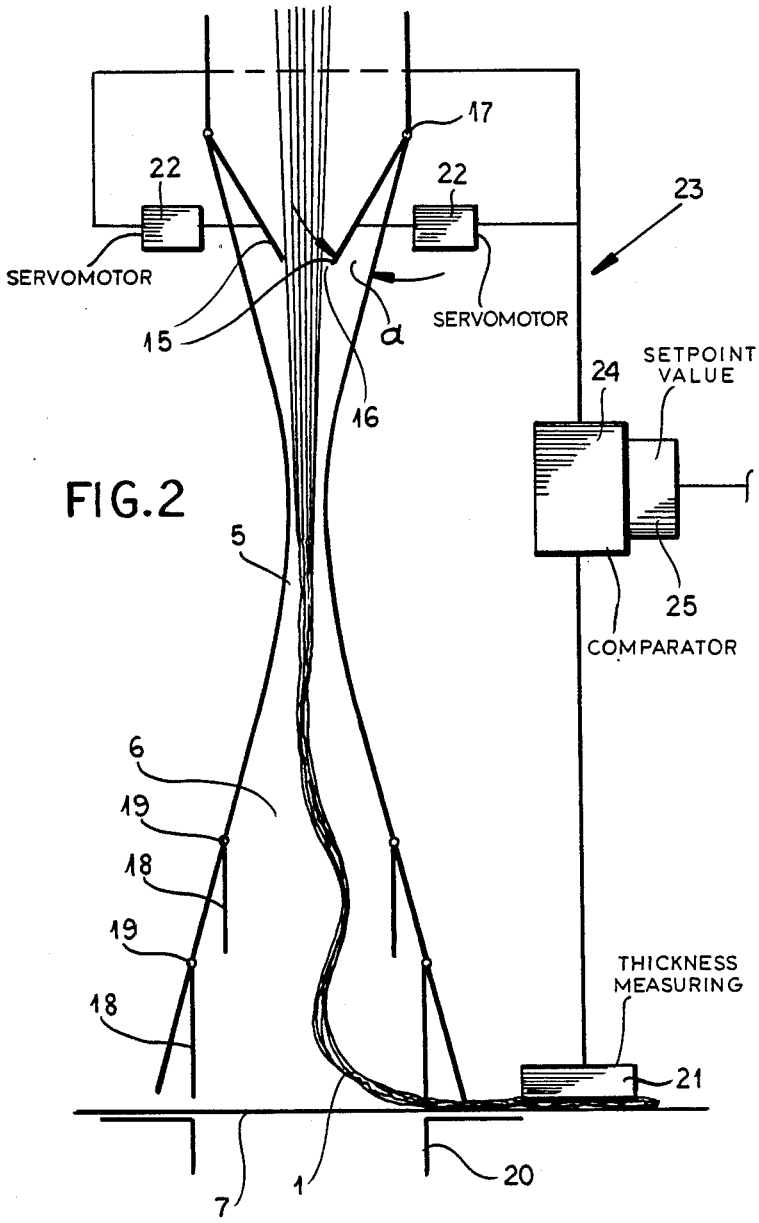
FIG. 2 is a vertical cross sectional view of the apparatus for making spun-filament fleece of FIG. 1 corresponding to the portion 11 indicated by the dot-dash line in FIG. 1 and drawn to a larger scale.

In FIG. 2 the different servomotor drives 22 are indicated as blocks. The thickness measuring device 21, the servomotor drives 22 of the air control flaps 15 with which the setting angle a is adjustable and the setpoint value adjustment are part of a feedback control loop 23 which is shown in FIG. 2.

A controller 24 with a setpoint value setting device 25 is also part of the feedback control loop 23. As a result a thickness control and thus a control of the surface weight occurs. The thickness of the spun-filament fleece 1 on the fleece receiving conveyor 7 is measured in the transport direction downstream of the diffuser shaft 6.

The measured value is compared with a predetermined setpoint value and the setting angles a of the air control flaps 15 which are located at the entrance of the stretching gap 5 are changed with the deviation of the measured value from the desired setpoint value. Of course the setting angle a is increased with a positive deviation from the setpoint value (measured value greater than the setpoint value), but decreased with a negative deviation from the setpoint value (measured value less than the setpoint value).

The device for feeding process air includes the adjustable damper 20, the shaft wall 11, the air baffles 14 and an air blower or pump (not shown).

I claim:

1. An apparatus for making spun-filament fleece comprising a spinneret for continuously emitting a multiplicity of thermoplastic filaments;

a cooling shaft connected to said spinneret and receiving said filaments;

a stretching gap downstream of said cooling shaft;

a diffuser shaft downstream of said gap;

a continuously moving fleece-receiving conveyor below said diffuser shaft;

a device associated with said conveyor for feeding process air and for pulling outflowing air through the fleece-receiving conveyor, said cooling shaft having a shaft wall providing with a plurality of air orifices through which air required for cooling can pass to provide an air flow which is at least partially drawn through said fleece-receiving conveyor;

a thickness measuring device along said conveyor for measuring the thickness of a mat of spun-filament fleece deposited on said conveyor and which is measurable at said mat of spun-filament fleece to provide respective measured values; and a pair of oppositely positioned elastically deformable air control flaps each having a respective horizontal pivot axis upstream of said stretching gap along the path of said filaments and having setting angles variable along their respective lengths and against said air flow according to the deviation of respective measured values form setpoint values.

2. The apparatus defined in claim 1 wherein said fleece receiving conveyor is a wire screen conveyor.

3. The apparatus defined in claim 1 wherein said thickness measuring device and said air control flap are provided in a feedback control loop with which a setpoint value of said thickness is associated.

4. A apparatus for making spun-filament fleece comprising:

a spinning nozzle system;

a cooling shaft below said spinning nozzle system and provided with a stretching gap, said cooling shaft having a shaft wall provided with a plurality of air orifices and process air required for cooling being inducible into said shaft through said air orifices to provide an air flow;

a diffuser shaft downstream of said cooling shaft;

a continuously moving fleece-receiving conveyor below said diffuser shaft;

a device below said conveyor for feeding process air and of drawing outflowing air through said fleece-receiving conveyor, said air flow being at least partially drawn through said fleece-receiving conveyor a thickness measuring device associated with said fleece-receiving conveyor for measuring the thickness of said spun-filament fleece to provide respective measured values; and at least two opposing air control flaps each having a horizontal pivot axis positioned along the path of said filaments upstream of said stretching gap, said flaps being elastically deformable over the lengths thereof and being provided with means for adjusting setting angles of said flaps against said air flow said setting angles varying over the lengths of the respective flaps according to the deviation of said measured values of said thickness form at least one setpoint value of said thickness, said thickness measuring device and said air control flaps with said setting angles being provided in a feedback control loop with which an adjustable one of said setpoint values of said thickness of said spun-filament fleece is associated.

* * * * *